US005100024A

United States Patent [19]

Bravo

[11] Patent Number: 5,100,024

[45] **Date of Patent: * Mar. 31, 1992**

[54] GASOLINE COLLECTOR PIT BOX AND SUBMERSIBLE UNIT BOX

[76] Inventor: Sergio M. Bravo, 1823 N. Hill Dr., South Pasadena, Calif. 91030

[ * ] Notice: The portion of the term of this patent subsequent to Jun. 27, 2006 has been disclaimed.

[21] Appl. No.: 534,040

[22] Filed: Jun. 5, 1990

Related U.S. Application Data

[63] Continuation of Ser. No. 353,889, May 18, 1989, Pat. No. 4,971,225, which is a continuation of Ser. No. 201,336, May 27, 1988, Pat. No. 4,842,163, which is a continuation of Ser. No. 909,289, Sep. 19, 1986, abandoned.

[51] Int. Cl.[5] ..... B67D 1/16

[52] U.S. Cl. ..... 222/40; 222/51; 222/110; 222/111; 405/54; 137/312; 141/45; 73/49.2; 248/678

[58] Field of Search ..... 220/85 VR, 85 VS; 405/53, 54; 137/374, 236.1, 312, 314; 248/678, 679; 141/45, 86; 417/9; 222/108–111, 40, 51, 64, 67, 377; 73/49.2 R, 49.2 T, 49.3, 40

[56] References Cited

U.S. PATENT DOCUMENTS

| | | | |
|---|---|---|---|
| 296,531 | 4/1884 | Cole . | |
| 671,798 | 4/1901 | Hamilton . | |
| 727,779 | 5/1903 | Frieseke . | |
| 1,520,230 | 12/1924 | Flath . | |
| 1,595,503 | 8/1926 | Crouse . | |
| 1,763,149 | 6/1930 | Gutmann et al. . | |
| 1,886,074 | 11/1932 | Wortmann . | |
| 2,239,270 | 4/1941 | Jahreis . | |
| 2,294,855 | 9/1942 | Thomason | 248/678 |
| 2,916,233 | 12/1959 | Ecker . | |
| 2,969,799 | 1/1961 | Kangas . | |
| 3,069,671 | 12/1962 | Taylor . | |
| 3,172,572 | 3/1965 | Brown et al. . | |
| 3,224,638 | 12/1965 | Harrell, Jr. . | |
| 3,295,327 | 1/1967 | Waterman . | |
| 3,300,983 | 1/1967 | Dougherty et al. . | |
| 3,695,289 | 10/1972 | Capdevielle et al. . | |
| 3,698,454 | 10/1962 | Cunha et al. . | |
| 3,721,270 | 3/1973 | Wittgenstein . | |
| 3,756,291 | 9/1973 | McGahey et al. . | |

(List continued on next page.)

FOREIGN PATENT DOCUMENTS

| | | | |
|---|---|---|---|
| 1238793 | 7/1988 | Canada . | |
| 1175502 | 8/1964 | Fed. Rep. of Germany . | |
| 1194209 | 6/1965 | Fed. Rep. of Germany . | |
| 1200619 | 9/1965 | Fed. Rep. of Germany . | |
| 1044399 | 9/1966 | Fed. Rep. of Germany . | |
| 1243375 | 1/1968 | Fed. Rep. of Germany . | |
| 1271602 | 2/1968 | Fed. Rep. of Germany . | |
| 1284757 | 12/1968 | Fed. Rep. of Germany . | |
| 2227852 | 12/1973 | Fed. Rep. of Germany . | |
| 2735804 | 2/1979 | Fed. Rep. of Germany . | |
| 2900960 | 7/1979 | Fed. Rep. of Germany . | |
| 1146512 | 3/1969 | United Kingdom | 222/377 |
| 1414218 | 11/1975 | United Kingdom . | |
| 2120794 | 12/1983 | United Kingdom . | |
| 2175037 | 11/1986 | United Kingdom . | |

*Primary Examiner*—H. Grant Skaggs
*Attorney, Agent, or Firm*—Christie, Parker & Hale

[57] ABSTRACT

An apparatus and a method for collecting in seal containers the gasoline that leaks or spills from service station dispensers or submersible pumps help to reduce the pollution associated with such equipment. The apparatus and the method also provide for returning the collected gasoline to the storage tanks via existing vapor recovery systems.

17 Claims, 5 Drawing Sheets

U.S. PATENT DOCUMENTS 3,815,327 6/1974 Viland .
3,848,765 11/1974 Durkop .
3,913,633 10/1975 Hiller .
4,012,945 3/1977 Bergstrand .
4,090,525 5/1978 Potter .
4,110,739 8/1978 Kidd .
4,110,947 9/1978 Murray et al. .
4,135,859 1/1979 Carson et al. .
4,161,957 7/1979 Schoellkopf .
4,239,131 12/1980 Emert et al. ..... 222/377
4,278,115 7/1981 Briles et al. .
4,457,349 7/1984 Vazin .
4,498,606 2/1985 DiRienzo ..... 222/52
4,523,454 6/1985 Sharp .
4,524,609 6/1985 Sharp .
4,537,328 8/1985 Kessee et al. .
4,561,292 12/1985 Pugnale et al. .
4,602,250 7/1986 Peace .
4,638,920 1/1987 Goodhues, Jr. .
4,639,164 1/1987 Pugnale et al. .
4,641,680 2/1987 Been .
4,659,251 4/1987 Petter et al. .
4,682,911 7/1987 Moreland .
4,708,015 11/1987 Sharp .
4,787,772 11/1988 Wagner .
4,842,163 6/1989 Bravo .
4,971,225 11/1990 Bravo ..... 222/51

OPEN

CLOSED

GASOLINE COLLECTOR PIT BOX AND SUBMERSIBLE UNIT BOX

This is a continuation of pending application Ser. No. 07/353,889 filed May 19, 1989 now U.S. Pat. No. 4,971,225, which was a continuation of Ser. No. 07/201,336 filed May 27, 1988, which issued on June 27, 1989 as U.S. Pat. No. 4,842,163 and which is a continuation of application Ser. No. 06/909,289 filed Sept. 19, 1986 now abandoned.

FIELD OF THE INVENTION

The present invention is directed to an apparatus and a method for collecting the gasoline that leaks or spills from service station dispensers or submersible pumps and, more particularly, to an apparatus and a method where the collected gasoline is returned to the storage tanks via an existing vapor recovery system.

BACKGROUND OF THE INVENTION

In recent years, increased awareness of the air and water pollution problems caused by leaking gasoline or other polluting elements has focused attention on ways to detect and prevent such leaking. For example, most service stations now provide vapor recovery systems to recover the gasoline vapors or fumes liberated during the filling of an automobile fuel tank. These vapors or fumes are displaced from the tank by the inflowing gasoline. Such systems are disclosed in U.S. Pat. No. 3,756,291 and U.S. Pat. No. 3,815,327. Systems have also been developed to detect and prevent leaks from underground storage tanks and their associated lines to prevent possible ground water contamination. One such system is disclosed in U.S. Pat. No. 4,161,957.

However, efforts at preventing pollution to date have ignored a major source of possible air and water pollution in service stations. The gasoline pumps or dispensers in a service station undergo routine maintenance on a regular basis. For example, the filters in a dispenser are typically changed once a month. When the maintenance worker removes an old filter, the gasoline present in the dispenser downstream of the filter drains onto the ground beneath the dispenser. This can amount to three to five gallons of gasoline. When one considers that this amount drains from each of the dispensers in a service station on a monthly basis, it is clear that the potential pollution problem is significant.

Gasoline drainage can also occur when less frequent types of repair work, such as changing the meters, are performed on gasoline dispensers. When meters are changed, it is also typical for the maintenance worker to run some gasoline through the dispenser to ensure that the dispenser is working properly. Although the worker should run this gasoline into a container, it is common for workers to run it onto the ground at the base of a dispenser when a container is not readily available. Therefore, gasoline drainage due to this type of repair work can also pose a significant pollution problem even though it occurs on an irregular basis.

Gasoline dispensers are fitted with a shear or impact valve at the point where the dispenser is mounted on the ground. This valve automatically shuts off the supply of gasoline to the dispenser when the dispenser is damaged by a vehicle. This prevents any further gasoline from leaking out of the damaged dispenser. However, the gasoline in the dispenser downstream of the impact valve will still drain onto the ground. Also, dispensers can develop slow leaks at gaskets or other points despite regular maintenance. Such slow leaks allow a steady trickle of gasoline to drain onto the ground.

The gasoline draining from a dispenser and spilling onto the ground creates an obvious air pollution problem through evaporation of the gasoline. The potential for ground water contamination also exists from the gasoline seeping into the ground. In addition to pollution problems, the spilling gasoline creates a fire hazard. A fire at a service station can be an especially dangerous event. Therefore, fire hazards should be minimized, if not eliminated. Furthermore, the spilling gasoline represents an economic loss to service station owners.

Accordingly, a need exists for an apparatus and a method for preventing the gasoline draining from gasoline dispensers from polluting the air or water. Such apparatus and method should also recover this gasoline and return it to storage so that it will not pose a fire hazard and so that gasoline losses will be reduced. It would also be preferable for the apparatus involved to be easy to install in existing service stations and compatible with existing equipment. Additionally, the method should preferably be adaptable to work with other potential sources of leaking gasoline, such as the submersible pumps in a service station.

SUMMARY OF THE INVENTION

In accordance with the present invention, an apparatus and a method for reducing pollution associated with gasoline handling equipment are provided. The apparatus is comprised of: means for collecting gasoline spilling from the gasoline handling equipment; and means for providing a signal when a predetermined amount of gasoline has accumulated in the means for collecting gasoline. The method is comprised of the steps of: collecting gasoline spilling from the gasoline handling equipment; and providing a signal when a predetermined amount of gasoline has accumulated as a result of collecting spilling gasoline. Preferably, the apparatus is also comprised of means for draining away gasoline that has accumulated in the means for collecting gasoline and the method is also comprised of the step of selectively draining away gasoline that has accumulated as a result of collecting spilling gasoline.

Alternatively, the apparatus for reducing pollution associated with gasoline handling equipment is comprised of: means for collecting gasoline spilling from the gasoline handling equipment; and means for draining away gasoline that has accumulated in the means for collecting gasoline. Likewise, the method for reducing pollution associated with gasoline handling equipment is alternatively comprised of the steps of: collecting gasoline spilling from the gasoline handling equipment; and selectively draining away gasoline that has accumulated as a result of collecting spilling gasoline.

It is preferable for the apparatus for reducing pollution to also comprise means for returning gasoline drained away to a storage tank. Also preferable is having the means for draining away gasoline connected to a vapor recovery system or having the means for providing a signal shut down the gasoline handling equipment when the predetermined amount of gasoline has accumulated. The gasoline handling equipment is preferably a gasoline dispenser or a submersible unit. Where the gasoline handling equipment is a gasoline dispenser having an access door it is preferred that the means for draining away gasoline can only be operated when the access door is open or that the means for draining away gasoline is automatically shut off when the access door is closed.

Also in accordance with the present invention, an apparatus and a method for pollution reduction are provided. The apparatus is comprised of: a container having an open top portion and a normally, substantially sealed lower portion able to receive polluting elements; and means responsive to the accumulation of polluting elements in the lower portion of the container for providing a signal when a predetermined amount of polluting elements have accumulated. The method is comprised of the steps of: positioning a container having an open top portion and a normally, substantially sealed lower portion so that it is able to receive polluting elements; and providing a signal when a predetermined amount of polluting elements have accumulated in the lower portion of the container. Preferably, the apparatus is also comprised of means for draining away the polluting elements accumulated in the lower portion of the container and the method is also comprised of the step of selectively draining away the polluting elements accumulated in the lower portion of the container.

DETAILED DESCRIPTION

Figure 1:
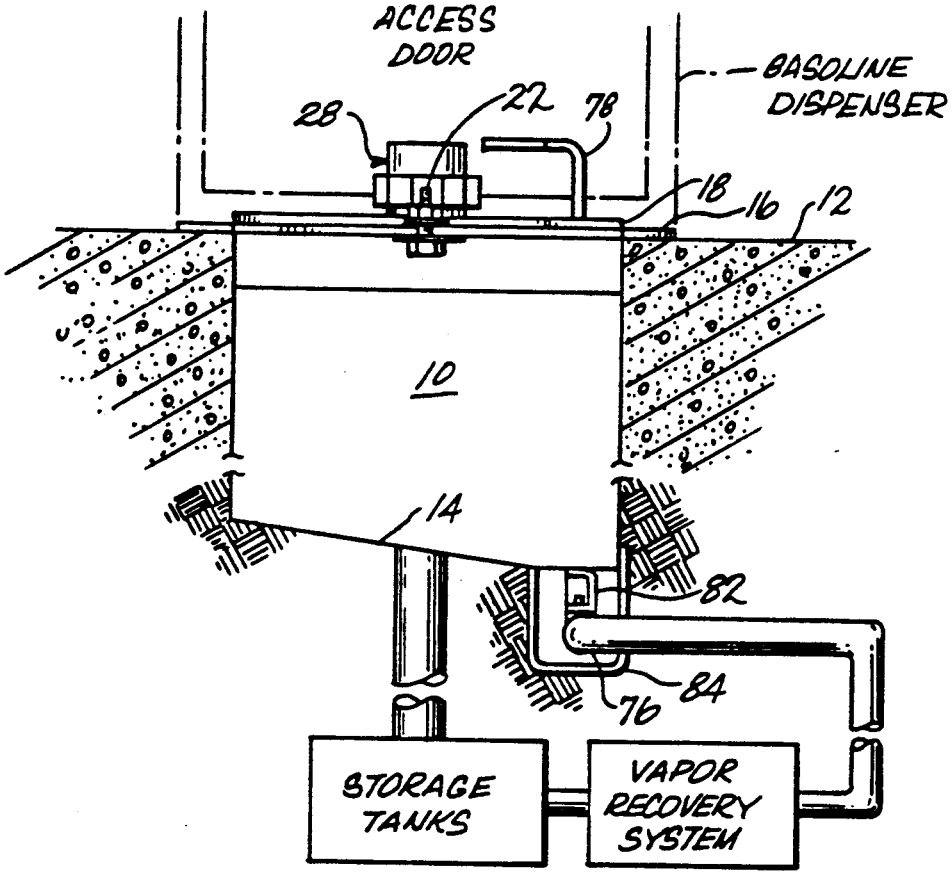
FIG. 1 is a front view of a gasoline collector according to the present invention for mounting beneath a gasoline dispenser.

With reference to FIG. 1, a gasoline collector 10 is shown installed in a concrete island 12 of the type typically found in service stations. Gasoline dispensers are normally mounted on such islands to protect them from wayward automobiles. However, the current practice is to mount dispensers over openings in the concrete island through which the gasoline lines and electrical lines necessary for the operation of the dispenser are run. Therefore, the internal workings of the dispenser are, for the most part, positioned over exposed dirt. Following the practice of the present invention, the dispenser is instead mounted over a gasoline collector 10 installed in the island.

Figure 2:
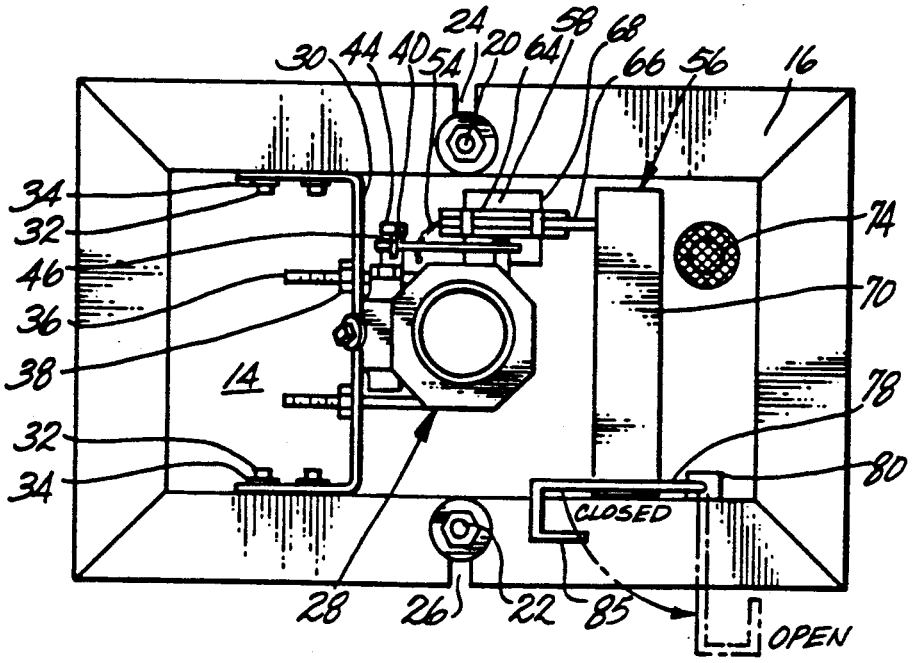
FIG. 2 is a top view of the gasoline collector of FIG. 1.

The housing for most gasoline dispensers has a rectangular base. This is why the gasoline collector depicted in FIGS. 1 and 2 is rectangular in shape. However, the present invention should not be understood as limited to any particular shape. Rather, the gasoline collector should be viewed as adaptable to conform with the shape of the gasoline dispenser or other equipment the collector is to be associated with. For example, some gasoline dispensers are now being grouped into single modules with a single elongated rectangular base. The gasoline collector of the present invention could be shaped so as to conform to such a base. Nonetheless, the preferred embodiment will be described with a rectangular base for a single-product dispenser in mind, because this is the type of dispenser most commonly used.

Gasoline collector 10 is a hollow, rectangular box with an open top and a slanted floor 14. Adjacent the open top of collector 10 is a flange 16 that extends axially outward from the walls of the collector. This flange rests on the top surface of concrete island 12 when the collector is installed. The walls of collector 10 extend above flange 16 for a short distance to provide a lip 18 for the collector that will prevent water from running into the interior of the collector during a rainstorm or during washing of the service station. The dimensions of the collector are chosen so that a gasoline dispenser can be mounted over the collector with the lower edges of its base resting on flange 16 adjacent lip 18. A pair of mounting bolts 20 and 22 extend through notches 24 and 26 in flange 16 to provide the means for fixing the dispenser in place.

It is presently preferred that collector 10 be made of 12 gauge galvanized steel sheets welded together and covered with a protective coating. However, the collector can be made of any durable material that resists corrosion and can stand up to contact with gasoline. In addition, the collector can be constructed in any manner that produces sturdy seams that do not allow gasoline to seep through. An important objective that should be kept in mind in selecting possible materials and methods of construction for the collector is that of preventing the gasoline collected from leaking out of the collector. Otherwise, effective pollution control will not be possible. To this end, the collector can be dipped in molten lead or solder after construction so that a coating is applied to the collector that will seal it against leaks and protect it from rust and corrosion.

An impact or shear valve 28 is provided in the gasoline supply line to the gasoline dispenser. This shear valve is designed to shut off the supply of gasoline to the dispenser should something like an automobile collide with the dispenser. Shear valves of this type are in common use with gasoline dispensers. Shear valve 28 is mounted inside collector 10 at its open top by a "U"-shaped mounting brace 30 (FIG. 2). This mounting brace extends across collector 10 so that its opposed ends can be attached to opposite walls of the collector. The opposed ends of the brace have openings therethrough to receive threaded studs 32 welded to the walls of the collector and extending outward therefrom. Nuts 34 threaded onto studs 32 and tightened down against the brace complete the attachment of the brace to the walls of the collector. The shear valve is, in turn, mounted on brace 30 by a "U"-shaped rod 36, threaded at both ends and received in openings extending through the portion of brace 30 that is extended across the collector. Rod 36 extends around and supports valve 28. Nuts 38 threaded onto each end of rod 36 hold it in place on brace 30.

Figure 3A:
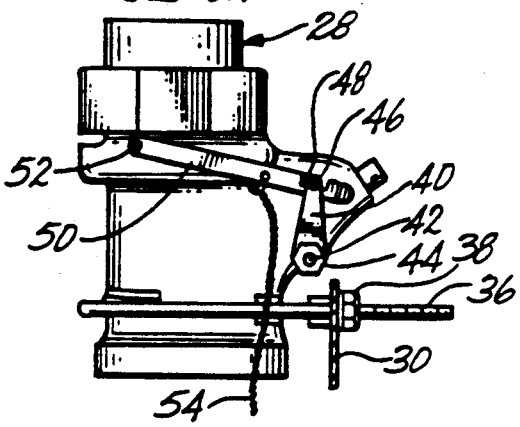
FIG. 3A is a back view of a shear valve mounted in the gasoline collector of FIG. 1 in the open position.
Figure 3B:
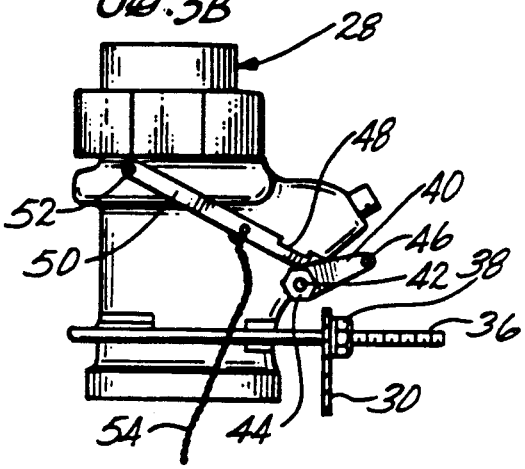
FIG. 3B is a back view of the shear valve of FIG. 3A in the closed position.

Valve 28 can be activated to close by a spring-loaded trigger 40 pivotally mounted by a pin 42 and a nut 44 on the outside of the valve (FIGS. 3A and 3B). Trigger 40 is a flat elongated member, one end of which pivots about pin 42, which extends out from the outer casing of valve 28. Nut 44 holds the trigger on pin 42. At the opposite end of the trigger, a pin 46 extends out from the surface of the trigger where it catches in a notch 48 cut into the top edge of one end of a latch bar 50. Latch bar 50 is also pivotally mounted on valve 28. It is pivotally mounted at the end opposite notch 48 by a pin 52 extending out from the outer casing of the shear valve. Trigger 40 is normally biased toward a position where valve 28 is closed, as shown in FIG. 3B. However, when the trigger is caught in notch 48, as shown in FIG. 3A, valve 28 is open. The valve will then stay open as long as it is not disturbed. A collision with the gasoline dispenser will jar the latch bar and trigger 40 will move to the closed position.

Figure 4A:
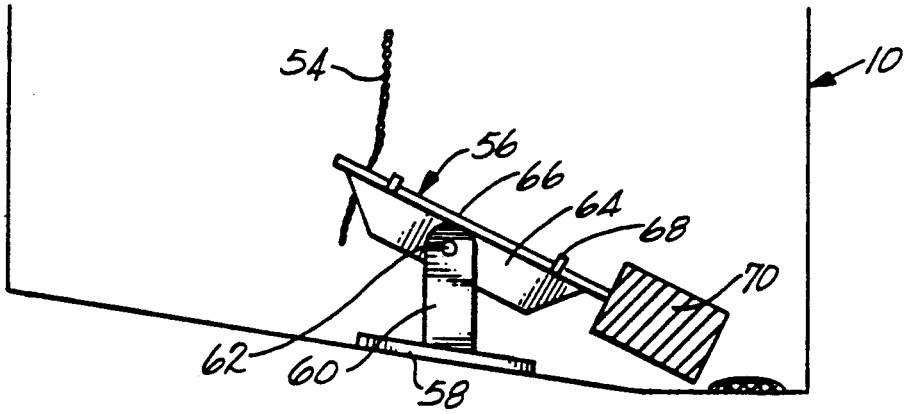
FIG. 4A is a sectioned front view of a float mechanism mounted at the bottom of the gasoline collector of FIG. 1 and connected by a chain to the shear valve of FIGS. 3A and 3B.
Figure 4B:
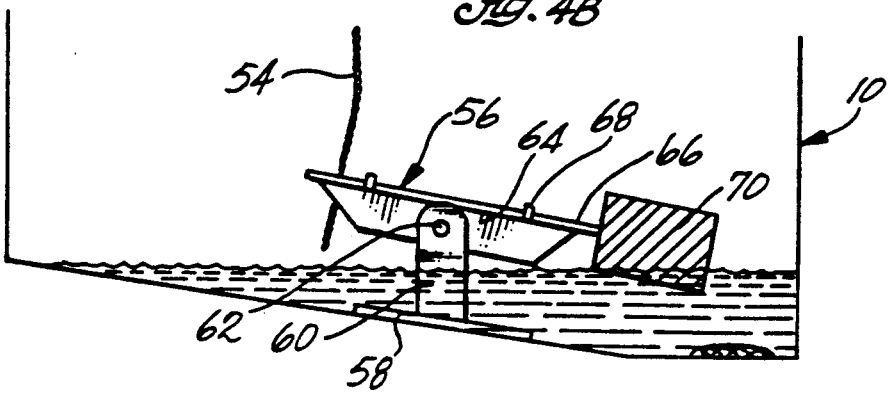
FIG. 4B is a sectioned front view of the float mechanism of FIG. 4A pivoted upward by gasoline accumulating at the bottom of the gasoline collector.

So far the above description of the shear valve and its operation has not departed from prior practice except for its being mounted in the gasoline collector of the present invention. However, shear valve 28 is also used to perform a function shear valves have not served in the past. For this reason, a chain 54 is connected at one end to latch bar 50. The other end of chain 54 is connected to one end of a float mechanism 56 mounted on the floor of the gasoline collector (FIGS. 4A and 4B).

A plate 58 attached to the floor of collector 10 has a pair of support members 60 extending upward therefrom opposite one another. A pin 62 is attached to and extends between the free ends of these two support members. Bracket 64 is rotatably mounted on pin 62. Chain 54 is connected to one end of elongated bracket 64. A rod 66 extends along the top surface of bracket 64 and is held in place by a pair of loops 68 extending up from the surface of the bracket to encircle the rod. At the end of bracket 64 opposite the chain, rod 66 extends out beyond the end of the bracket and has a float 70 attached to its end.

Float mechanism 56 is designed so that the point where chain 54 is connected to bracket 64 and float 70 are on opposite sides of the pivot point for the bracket at pin 62. Therefore, if the float is raised up, a downward force will be exerted on latch bar 50 through the chain so that valve 28 will be closed. Then, if gasoline is leaking from the dispenser, it will accumulate in the sealed collector. After a sufficient amount of gasoline has accumulated to raise the float, valve 28 will close and the dispenser will thereby be shut down. When this happens, the service station owner is alerted that a leak is occurring and can have the dispenser repaired.

As mentioned earlier, the floor of collector 10 slants toward one side. It is presently preferable to have float 70 positioned toward the low end of the collector. This allows the float mechanism to react more quickly to an accumulation of gasoline in the bottom of the collector. If the collector is positioned below a group of dispensers in a single module, where each dispenser has its own gasoline supply line and associated shear valve, a single float mechanism can still be used with the chains from each shear valve connected to the bracket. Alternatively, separate floats in partitioned areas of the collector, each float with its own low point, can be used so that only the leaking dispenser is shut down.

Although the presently preferred embodiment has been described as using a float mechanism, it should be understood that what is important is the provision of a means for alerting the service station operator that gasoline is accumulating in the collector, i.e., providing an externally manifested signal. Other means could be used to shut down the dispenser when accumulation is occurring or a warning signal could be used in place of shutting down the dispenser as a way of notifying the operator of the accumulation. In any event, accumulation of gasoline should be minimized to reduce the likelihood of a fire. Therefore, it is preferable to have the warning signal triggered for even low levels of accumulation. Also, the overall volume of the collector should not be excessive so that if the warning signal is ignored or does not operate for some reason a large amount of gasoline will not accumulate. Although this means in some instances the gasoline may be allowed to overflow the collector and defeat the pollution control aspects of the invention, the prevention of a fire hazard must take precedence in some situations.

As described above, gasoline collector 10 acts primarily as a device for collecting leaking gasoline and providing warnings to an operator of excessive accumulations during the normal operation of a dispenser. However, during maintenance operations large accumulations of gasoline will occur due to gasoline draining from the dispenser. Therefore, it is important to provide the gasoline collector with a means for draining off such accumulations. Preferably this drainage means will operate in a closed loop fashion so that the gasoline is returned to storage without the need for additional work by the maintenance worker. This would also allow the maintenance worker to run some gasoline into the collector to ensure the dispenser was operating properly without having to obtain a separate container.

Figure 5A:
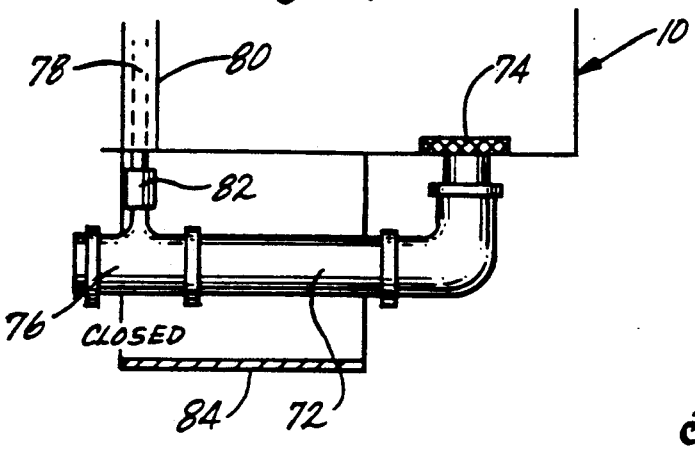
FIG. 5A is a sectioned side view of the drain system for the gasoline collector of FIG. 1 in the closed position.
Figure 5B:
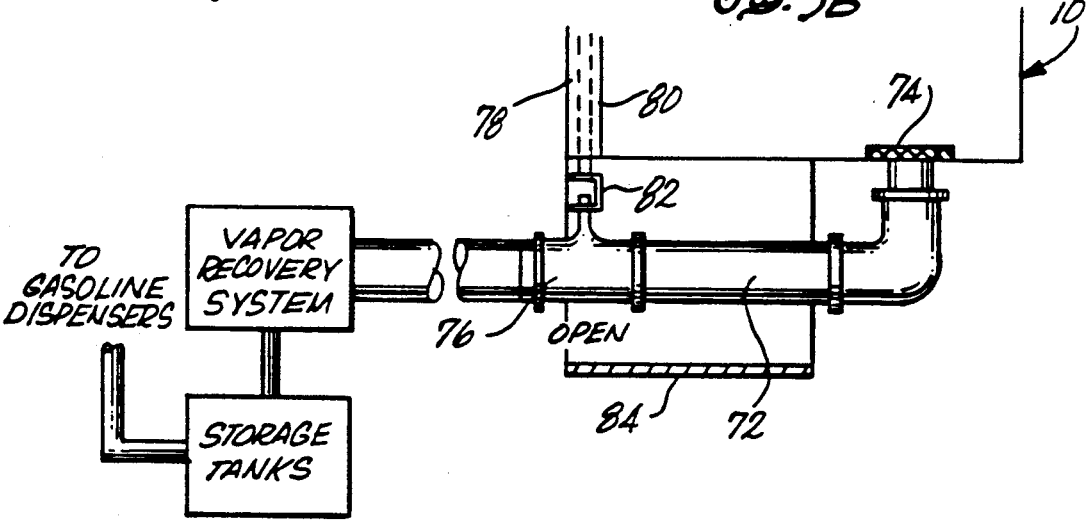
FIG. 5B is a sectioned side view of the drain system of FIG. 5A in the open position.

A drainage pipe 72 is provided for collector 10 (FIGS. 5A and 5B). The mouth for this pipe is in the floor of the collector and is preferably situated at the low point so that drainage is aided by the slant of the floor and so that no gasoline will remain in the collector after drainage. The mouth of drainage pipe 72 is covered by a mesh filter or screen 74 to keep garbage out of the drainage system. Because it is desirable to drain the collector to storage, it is presently envisioned that drainage pipe 72 be hooked into the vapor recovery systems present in most, if not all, service stations (FIG. 5B). These vapor recovery systems already carry vapors from the gasoline dispenser nozzles back to the underground storage tanks. Therefore, the gasoline drained from the collector will also be carried back to the underground storage tanks without the need for installing a separate system to make this possible.

A ball valve 76 is provided in drainage pipe 72 to control the drainage of the collector. This ball valve can be opened and closed by turning a generally "L"-shaped hand crank 78 that extends up from the ball valve along the front wall of the collector to a point above the open top of the collector. The stem of hand crank 78 is surrounded by an elongated housing 80 welded to the front wall of gasoline collector 10. This stem rotates within the housing when the upper portion of the hand crank, which is at right angles to the stem, is turned through 90 degrees (FIG. 2). The lower end of the stem is fixedly attached to a "C"-shaped fitting 82 below the floor of the collector and just above the ball valve. Housing 80 prevents gasoline from escaping through the opening where the stem extends through the floor of the collector The lower end of the stem is attached to one of the opposed ends of fitting 82. The other end of fitting 82 is attached to the valve stem so that the valve is opened and closed when the upper portion of the hand crank is rotated through 90 degrees.

Hand crank 78 is designed so that when the upper portion of the hand crank is roughly parallel to the front wall of the collector the ball valve is closed. A frontwardly extending "L"-shaped piece 85 is attached to the upper portion of the hand crank that will abut with the door on the gasoline dispenser housing when that door is closed. This means that when the dispenser door is closed the ball valve has to be closed. This is a safety feature that prevents the drain from being left open and thereby placing a constant strain on the vapor recovery system. Even if a maintenance worker forgets to turn the hand crank to the closed position, the closing of the dispenser door will close the drain and preserve the integrity of the vapor recovery system.

Then, when maintenance work is being done on a dispenser, the maintenance worker need only turn the hand crank to the open position to provide a drain for any gasoline spilled into the collector. Likewise, any vapor will be drawn into the drain by the suction of the vapor recovery system. This drainage system can also be used to eliminate excessive accumulations occurring due to leaks during normal operation of the dispenser so that the service station operator can keep a dispenser in operation until the leak can be repaired. In fact, the operator should drain excessive accumulations when notified that they are present to reduce the risk of a fire.

Ball valve 76 is protected by a valve guard 84 from being clogged with dirt. This valve guard extends down from the floor of the gasoline collector to form a tunnel around the ball valve. This prevents dirt from coming into contact with the underside of the ball valve when the gasoline collector is lowered into the ground.

Figure 6:
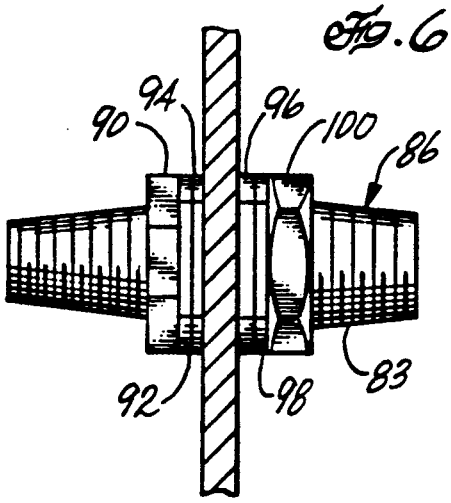
FIG. 6 is a sectioned side view of a fitting for running a line through a wall of the gasoline collector of FIG. 1.

With reference to FIG. 6, a fitting 86 is shown that can be used to bring lines through the walls or floor of the collector without adversely affecting the seal. When a line must be run to the dispenser from outside of the collector, a hole is cut in the wall or floor of the collector at the point where the line is to run. The fitting 86, which will have a diameter appropriate for the particular line involved, is placed in the hole and the conduits for the line involved attached to either end of the fitting. Fitting 86 has a hollow, tubular body 88 that is externally threaded on both ends. Adjacent the threads at one end is a fixed, outwardly extending axial flange 90 that is hexagonal in shape.

To attach fitting 86 to the wall of the collector, a metal washer 92 and then a neoprene washer 94 are slipped over the end of the fitting remote from flange 90 until they are lined up next to the flange. Then, the end of the fitting remote from the flange is slid through the hole in the wall or floor of the collector until the wall or floor of the collector abuts neoprene washer 94. A second neoprene washer 96 and a second metal washer 98 are then slipped over the end of the fitting remote from the flange until they are lined up next to the wall or floor of the collector on the side opposite the other washers. To tighten the fitting onto the wall, a hexagonal bolt 100 is threaded onto the end of the fitting remote from the flange and tightened down against washer 98. The neoprene washers act to prevent leaks at the fitting. Conduits of the line involved can now be threaded onto the opposite sides of the fitting.

Although the fitting just described is the presently preferred means for bringing lines through the walls or floor of the collector, it should be understood that any such means that will maintain the sealed nature of the collector is within the broad conception of the present invention. The presently preferred means is considered particularly advantageous for installing the collector beneath existing dispensers because it allows for great flexibility in placement of the lines.

Figure 7:
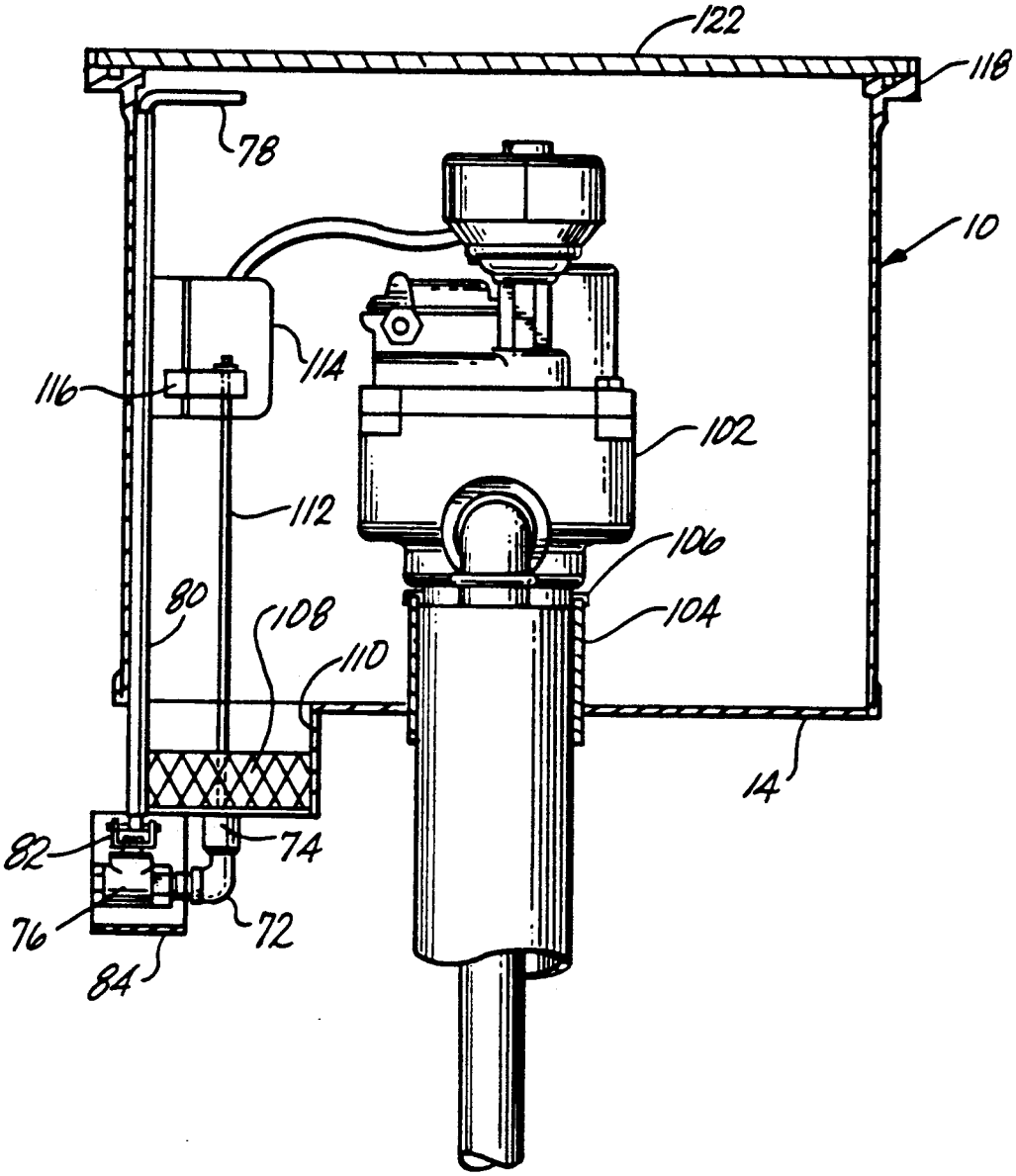
FIG. 7 is a sectioned front view of an alternate embodiment of a gasoline collector according to the present invention for use with a submersible pump.
Figure 8:
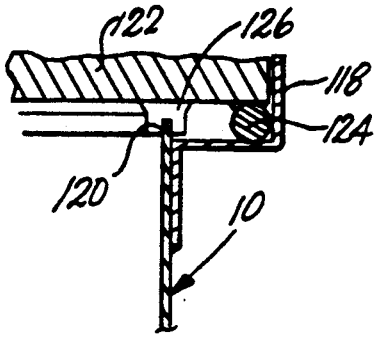
FIG. 8 is a sectioned front view of a seal formed at the top edge of the gasoline collector of FIG. 7.
Figure 9:
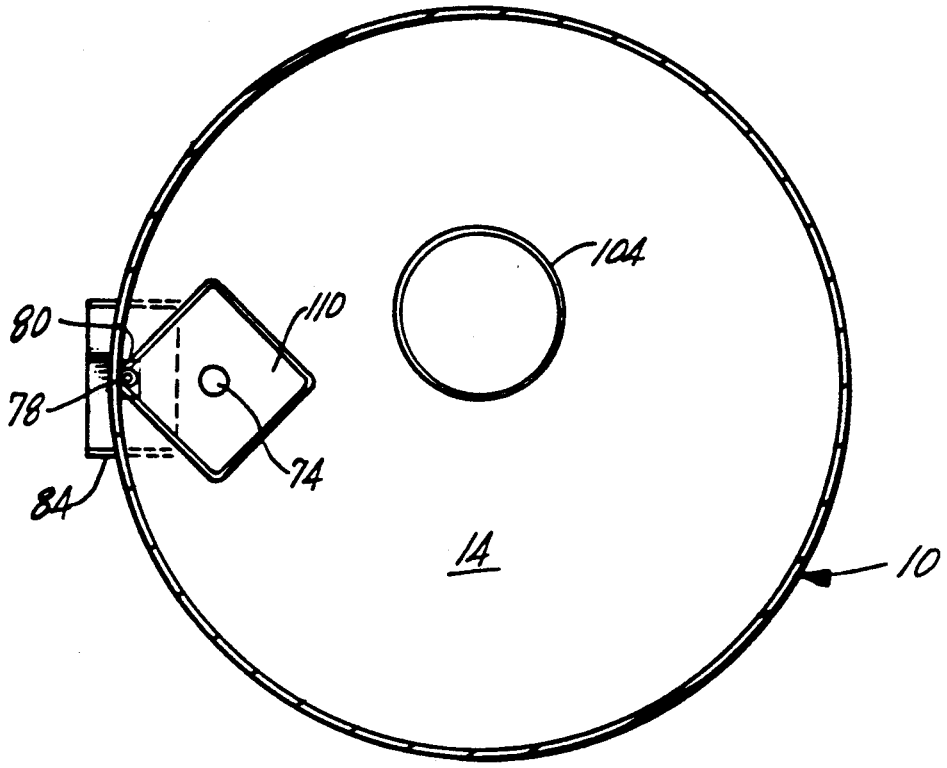
FIG. 9 is a top view of the floor of the gasoline collector of FIG. 7.

So far the present invention has been described in connection with gasoline dispensers. However, the present invention can be adapted to have utility with all types of gasoline handling equipment For example, FIGS. 7, 8 and 9 show an alternate embodiment of the present invention adapted to be used in connection with the submersible pumps or units that transfer gasoline from the underground storage tanks at a service station to the dispensers. These pumps are ordinarily mounted just below ground level and are accessible through a grate or floor plate. As any pump, these pumps are susceptible to leaking. Currently, any gasoline leaking from such pumps will evaporate or seep into the ground. With the present invention this source of possible air and water pollution is reduced or eliminated.

The embodiment of FIGS. 7, 8 and 9 shares many features in common with the previously described embodiment. Therefore, these common features will be designated with common numbers and will not be described in detail a second time except to the extent their operation has changed.

The primary change necessary to adapt the present invention to a submersible pump 102 is the provision of a tube 104 extending horizontally through the floor of the collector to accommodate the conduit of the pump that extends down to the underground storage tank. The tube is welded at a point along its length to the floor of the collector and extends above the floor for some distance to help prevent gasoline from leaking over its top lip. To further help prevent gasoline from leaking over the top lip of tube 104, a rubber seal 106 is attached around the top lip. This seal will contact pump 102 when the collector is installed (FIG. 7). Therefore, gasoline leaking from the pump will be collected in the bottom of the collector.

The float mechanism has also been modified in the alternate embodiment of FIGS. 7, 8 and 9. A float 108 rests at the bottom of a well 110 in the floor of the collector. This well has a rectangular cross-section and is positioned so that one corner of the well is in line with the wall of the collector. The floor of the collector should be sloped slightly so that gasoline will drain into the well. The mouth of the drainage system, then, is located in the floor of the well. Therefore, the gasoline collected will accumulate at the bottom of the well and exert an upward force on float 108. As shown in the drawing, the well preferably occupies substantially less than half the flow of the collector, similar to as in FIGS. 4A and 4B.

A rod 112 is attached to the top surface of float 108 and extends upward to an explosion-proof microswitch 114 mounted on the wall of the collector. The upper end of rod 112 is attached to a lever arm 116 on the microswitch. When an accumulation of gasoline in the well causes the upward movement of float 108, rod 112 transmits this movement to the lever arm. Eventually, the upward movement triggers the microswitch to shut down the submersible pump. This, in turn, alerts the service station operator that the pump is leaking and that maintenance is required. As with the other float mechanism, alternate approaches can be taken to alerting the service station operator of an excessive accumulation of gasoline.

In the embodiment of FIGS. 7, 8 and 9, a flange 118 is welded to the outside surface of the wall of the collector just below the upper edge of the wall. This flange extends axially outward and then turns upward as shown in detail in FIG. 8. The upwardly extending portion of flange 118 extends upward to a point where its top edge will be flush with ground level when the collector is installed. The wall of the collector extends upward past the axially extending portion of flange 118 to form a lip 120 but it does not extend upward to ground level. A circular floor plate 122 is to be placed over the top opening of the gasoline collector. Plate 122 is dimensioned so that its edge rests next to the upwardly extending portion of flange 118. A lid ring 124 with a circular cross section is welded to the underside of plate 122 adjacent its edge. The lid ring is dimensioned so that when plate 122 is in place with the bottom of ring 124 resting on the axially extending portion of flange 118 the top surface of the plate will be flush with ground level.

A rubber seal ring 126 is mounted on lip 120 and extends upward so that it is squeezed slightly by the underside of plate 122 when the plate is in place. This creates a seal around the top edge of the collector and traps gasoline fumes inside the collector. To maintain the sealed condition of the collector, plate 122 should be solid. In addition to trapping fumes inside, the seal prevents water from getting down into the collector. As with the dispenser embodiment, ball valve 76 can be operated by turning the top portion of hand crank 78 extending up along the wall of the collector. This hand crank will not automatically be turned to a closed position when the floor plate is in place. However, the integrity of the vapor recovery system will be maintained because this embodiment of the collector is more airtight.

As shown in FIG. 9, the submersible unit embodiment of the collector has a circular cross-section to match the round floor plate. This illustrates the flexibility of the current invention with regard to the geometric configuration of the collector. The configuration can be adapted to the gasoline handling equipment the collector is to be used in connection with.

Figure 10:
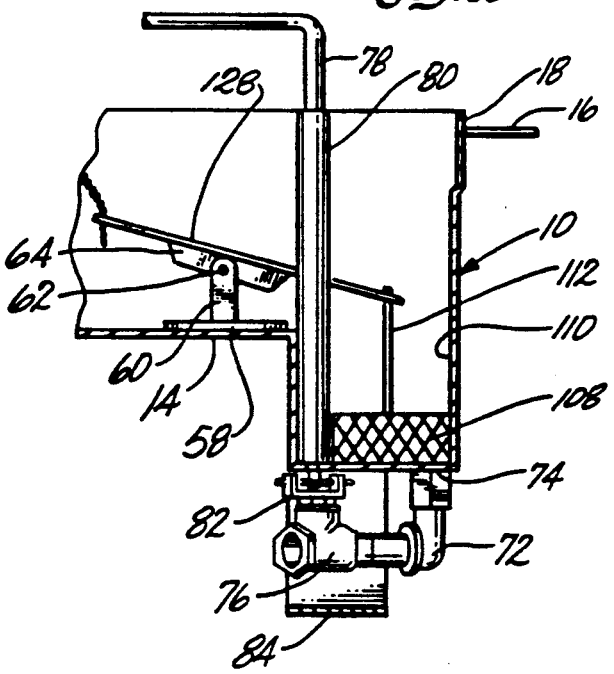
FIG. 10 is an alternate embodiment for a float mechanism mounted at the bottom of a gasoline collector according to the present invention.

The well used in the submersible unit embodiment has the advantage of amplifying the effect of gasoline accumulation. In other words, a smaller amount of gasoline accumulation can be used to trigger the float and the means for alerting the service station operator. When it is desirable to provide a collector with a sensitive float mechanism, a well can be used. With reference to FIG. 10, this alternative embodiment for the float mechanism is shown as adapted for a gasoline collector to be used in connection with a dispenser. This embodiment basically represents a combination of features from the two float mechanisms described previously. Therefore, the features described earlier will be designated with the same numbers.

In the float mechanism embodiment of FIG. 10, well 110 is located in one corner of the rectangular collector. The floor of the collector should be sloped so that the gasoline collected will drain into the well. Rod 112 extends up from the top surface of float 108 and is connected to one end of a lever arm 128 that is mounted on bracket 64. Therefore, when the float moves upward due to an accumulation of gasoline, rod 112 transmits this upward movement to lever arm 128 so that it pivots upward about pin 62 at the end opposite the end chain 54 is connected to. This results in a downward pull on chain 54 so that valve 28 will be closed if an excessive amount of gasoline accumulates. Using a well like this, valve 28 can be closed if just a few ounces of gasoline accumulate. Thus, the risk of a fire is minimized.

Alternate preferred embodiments of an apparatus and a method for reducing the air and water pollution caused by gasoline handling equipment have been described. These embodiments reduce gasoline losses and reduce the risk of fire associated with equipment of this type. However, it will be understood by those skilled in the art that changes in the form and detail of these embodiments may be made without departing from the spirit of the invention.

What is claimed is:

1. An apparatus for reducing pollution and fire hazard associated with a gasoline dispenser, comprising:

means disposed underneath and adjacent to the gasoline dispenser for collecting gasoline spilling from the gasoline dispenser;

means for providing an externally manifested signal when a predetermined amount of gasoline has accumulated in the means for collecting gasoline; and means for amplifying the effect of gasoline accumulation so that the means for providing an externally manifested signal can be triggered for even low levels of accumulation, wherein the means for collecting has a substantially flat bottom with a predetermined surface area and the means for amplifying comprises a well having substantially vertical side walls with respect to the flat bottom, the well being formed in substantially less than one half of the predetermined surface area of the bottom, the means for providing being disposed in the well below a level of the flat bottom of the means for collecting.

2. An apparatus according to claim 1, further comprising means for selectively draining away gasoline that has accumulated in the means for collecting.

3. An apparatus for reducing pollution according to claim 1, wherein the means for providing a signal comprises means for shutting down the gasoline dispenser when the predetermined amount of gasoline has accumulated.

4. A method for reducing pollution and fire hazard associated with a gasoline dispenser, comprising the steps of:

positioning a container with an opening directly below and adjacent to a gasoline dispenser and collecting gasoline leaking from the gasoline dispenser in the container;

amplifying the effect of gasoline accumulation; and providing an externally manifested signal when the amplified effect of gasoline accumulation is a predetermined amount, so that an externally manifested signal can be provided for even low levels of accumulation.

5. A method according to claim 4, further comprising a step of selectively draining away gasoline that has accumulated in the container as a result of collecting leaking gasoline.

6. A method according to claim 4, wherein the container has a flat bottom having a predetermined surface area, and a well is formed in the bottom in substantially less than one-half of the predetermined surface area, and the step of amplifying comprises collecting the leaking gasoline in the well.

7. A method according to claim 4, wherein providing the externally manifested signal comprises closing an impact valve to prevent gasoline from passing to the gasoline dispenser.

8. A method according to claim 4, wherein the container has walls and a flange extending around the walls at the open top, and in the step of positioning, the flange is supported on a concrete island, and the dispenser is supported on the flange.

9. A combination of an apparatus for reducing pollution and fire hazard from leaking gasoline and gasoline handling equipment, wherein the gasoline handling equipment comprises a gasoline dispenser having a base, and the apparatus comprises:

a container having an open top for collecting gasoline leaking from the gasoline dispenser; and means for fixing the container to the base of the gasoline dispenser with the open top positioned below and facing the dispenser;

wherein the apparatus further comprises means for amplifying an amount of leaking gasoline collected in the container, and means for sensing when the amplified amount reaches a predetermined amount, and for providing an externally manifested signal in response thereto, so that the eternally manifested signal is provided for even low levels of accumulation.

10. The combination of claim 9, wherein the container further comprises a flange around the container at the open top, and the dispenser base is disposed on the flange.

11. The combination of claim 10, wherein the container further comprises walls, the walls extending above the flange so as to form a lip around the opening.

12. The combination of claim 9, wherein the means for amplifying comprises a well formed in a bottom on the container.

13. The combination of claim 9, wherein the means for amplifying comprises a sloped bottom of the container.

14. The combination of claim 12, wherein the bottom has a predetermined surface area, and the well is formed in the bottom in substantially less than one half of the predetermined surface area.

15. The combination of claim 9, wherein the apparatus further comprises means for selectively draining away gasoline that has accumulated in the container as a result of collecting leaking gasoline.

16. The combination of claim 9, wherein the means for sensing and for providing the externally manifested signal comprises means for preventing a flow of gasoline to the gasoline dispenser.

17. The combination of claim 9, wherein the gasoline handling equipment further comprises an impact valve, and the container has the impact valve in it.

* * * * *